US008123008B2

(12) United States Patent
Thomas

(10) Patent No.: US 8,123,008 B2
(45) Date of Patent: Feb. 28, 2012

(54) ARTICLE SECUREMENT SYSTEM

(76) Inventor: Jeffrey Robert Thomas, Denver, CO (US)

( * ) Notice: Subject to any disclaimer, the term of this patent is extended or adjusted under 35 U.S.C. 154(b) by 626 days.

(21) Appl. No.: 11/672,041

(22) Filed: Feb. 6, 2007

(65) Prior Publication Data

US 2009/0095588 A1 Apr. 16, 2009

(51) Int. Cl.
*A45C 3/00* (2006.01)

(52) U.S. Cl. ..... 190/108; 190/102; 224/401

(58) Field of Classification Search ..... 16/426, 16/428; 190/108; 224/401
See application file for complete search history.

(56) References Cited

U.S. PATENT DOCUMENTS 2,581,417 A * 1/1952 Jones ..... 280/645
3,188,130 A * 6/1965 Pietrowicz ..... 294/74
4,537,436 A * 8/1985 Pfortmiller ..... 294/150
5,024,458 A * 6/1991 Kazmark et al. ..... 280/645
5,026,089 A * 6/1991 Grimmonpre ..... 280/655
5,131,707 A * 7/1992 Zazzara et al. ..... 294/156
5,890,571 A * 4/1999 Sadow ..... 190/102
5,927,450 A * 7/1999 Sadow ..... 190/102
6,457,763 B2 * 10/2002 Cornelius ..... 294/153
7,093,324 B2 * 8/2006 Udy ..... 16/428
7,226,351 B1 * 6/2007 Sliger et al. ..... 452/188
2006/0085950 A1 * 4/2006 Udy ..... 16/428
2006/0260893 A1 * 11/2006 Drew et al. ..... 190/108

* cited by examiner

*Primary Examiner* — Tri Mai

(57) ABSTRACT

An article securement system for attaching an article to another article, such as article of luggage to another article of luggage. The article securement system includes a cord, such as an elastic cord, that is inserted through a handle. A cord locking mechanism is mounted on the cord as well. A second handle may be mounted on the cord as well with the cord locking mechanism between the two handles. In use, the cord is secured to a first attachment point on the first article, such as on a luggage handle. The cord and handle are pulled over the second article and engages over a second attachment point on the first article, such as an extendible handle. The cord is then through the handle until the tension is sufficient on the cord to secure the second article. The cord locking mechanism is then used to lock the cord from movement relative to the handle.

6 Claims, 4 Drawing Sheets

ARTICLE SECUREMENT SYSTEM

FIELD OF THE INVENTION

This invention relates to the field of article securement systems and more particularly to the field of attaching articles to other articles such as luggage for transport.

BACKGROUND OF THE INVENTION

It is often necessary to transport multiple items particularly when traveling on mass transport. This may include transporting personal items, packages or luggage along with another article of luggage or wheeled cart, multiple articles in a cargo bed of a vehicle and many other instances. Often, it is necessary to use some type of a securing system to ensure that the articles do not become loose or separated during transport.

There are numerous systems available to secure such articles for transport. These systems range from ropes and straps, elastic cords, chains and turnbuckles to elaborate locking rooftop and cargo bed locking systems. Usually an elastic cord having hooks on each end are used in these situations. The use of these cords is often less than desirable due to lack of adjustability, the damage from the hooks, the inability to find secure attachment points and many other reasons.

It has become common to use wheeled carts, such as dollies, to transport luggage, briefcases, boxes and other articles. These articles are typically secured with straps, elastic cords and other types of securing devices. These securing devices are typically a generic elastic cord with hooks that are secured to the cart over the articles. These elastic cords are often accidentally detached causing the articles to spill from the cart and may damage the cart and articles from the hooks. These elastic cords are also relatively unattractive as well. Also, their length is often not suitable to safely secure the articles to the cart and require extensive manipulation to secure the articles.

Presently, luggage is frequently provided with extendable handles and wheels to make their transport easier. This type of luggage is becoming very popular. However, the use of more than one article of luggage having these wheels is difficult. Thus it has become necessary to be able to stack additional articles on top of the wheeled luggage.

There are presently luggage systems available that have separable component articles that may be secured onto a wheeled article of luggage. However this type of system requires an extensive purchase and prevents articles that are not part of the system from being transported. Also it is often difficult to access items contained in the components, such as a purse, knapsack, briefcase, etc. The components also typically attach to one another in such a manner that causes the load to be unbalanced and awkward.

Another problem with the use of the attachment systems for securing auxiliary articles is their lack of adjustability. This prevents them from being used with various sizes and types of articles and limits their effectiveness.

Thus a need exists for an article securement system that enables an article to be safely secured to another article for transport, that can be used with a wide variety of sizes and types of articles, that is easily adjustable and that can be safely stowed when not needed.

SUMMARY OF THE INVENTION

The present invention solves these and other problems by providing an adjustable article securement system. The system of the present invention enables a second article to be securely attached to a first article. An example of such a use is attaching an article of luggage or personal item to another article of luggage that has wheels and an extendible handle. It can also be used with any other type of articles, such as but not limited to securing a package, equipment, or other articles to a cargo bed of a vehicle.

In a preferred embodiment of the present invention, the article securement system includes a cord that has a handle and a cord locking mechanism. The cord is secured to a first attachment point and pulled over the article being secured. The cord and handle are then pulled over and engage a second attachment point. The cord is pulled taut and secured with the cord locking mechanism to maintain the tension over the article.

In another preferred embodiment, the article securement system includes an elastic cord with a handle and cord locking mechanism. The elastic cord is secured to a first attachment point and pulled over the article being secured. The cord and handle are then pulled over and engage a second attachment point. The cord is pulled taut and secured with the cord locking mechanism to maintain the tension over the article.

The article securement system of a preferred embodiment includes an elastic cord inserted through a first handle. A second handle is attached to the ends of the cord with a cord locking mechanism inserted between the two handles. The elastic cord is attached to a first attachment point and pulled over the article being secured. The cord and first handle then engage a second attachment point. The second handle is then pulled away from the first handle to adjust the tension on the cord over the article. Once the tension is sufficient to secure the cord over the article, the cord locking mechanism then locks the cord from movement relative to the first handle.

One use of the article securement system of the present invention is to secure an article of luggage or personal items to a second article of luggage having wheels and an extendible handle. The cord is attached to the first article of luggage, such as by looping through the handle on the luggage. The second article is placed on the first article with the cord pulled over the second article. The cord and first handle is pulled over the extendible handle so the handle engages against the extendible handle. The user then grasps the second handle with one hand and pushes the cord locking mechanism against the first handle until the tension is sufficient to secure the second article. The cord locking mechanism is then used to lock the cord to maintain that tension. The cord locking mechanism can be released to release the tension on the cord to allow the two articles to be disengaged from one another.

These and other features of the present invention are evident from the ensuing detailed description of preferred embodiment, from the claims and from the drawings.

DETAILED DESCRIPTION OF PREFERRED EMBODIMENTS

Figure 1:
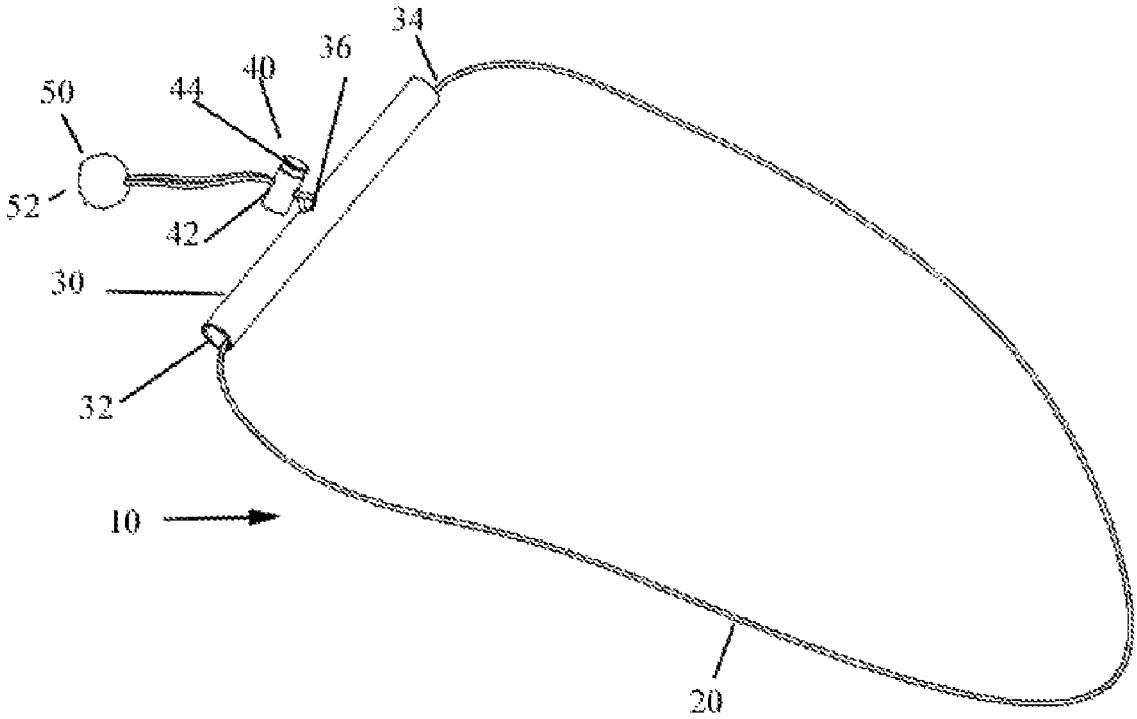
FIG. 1 is a perspective view of the article securement system of a preferred embodiment of the present invention.

The present invention provides systems and methods for securing articles of luggage for transport. It is to be expressly understood that this exemplary embodiment is provided for descriptive purposes only and is not meant to unduly limit the scope of the present inventive concept. Other embodiments and variations of the article securing system of the present invention are considered within the present inventive concept as set forth in the claims herein. Also, the present invention is primarily discussed for use with luggage for descriptive purposes only and is not meant to be limited solely to this use. It is to be expressly understood that other devices are contemplated for use with the present invention as well.

A preferred embodiment of the present invention is illustrated in FIGS. 1-7. The securement system 10 of this preferred embodiment of the present invention includes an elastic cord 20, handle 30, cord locking mechanism 40 and ball 50. The elastic cord 20 is preferably a high strength elastic or shock cord with a wear resistant outer covering. It is to be expressly understood that any type of elastic or non-elastic cord may be used within the scope of the present invention.

The elastic cord 20 may be integrally formed in a closed loop, or as shown in this preferred embodiment, it may be a single length of cord. This allows the overall length of the cord to be easily adjusted by cutting the cord to a desired length. In this preferred embodiment, the cord is about fifty-four inches long which when doubled as shown is suitable for use with standard sizes of luggage. However a longer length of cord may be used or the cord length may be easily shortened.

The handle 30 is a tubular cylinder formed from plastic, metal, wood or any other suitable material. The handle includes open ends 32, 34 and central aperture 36. Each end of the cord 20 is inserted through the opposing open ends 32, 34 and pulled through the central aperture 36. It is to be expressly understood that other types of handles may be used other than the aforementioned tubular cylinder. Other sizes and shapes of handles may be used, or the handle can even be eliminated.

The cord 20 is then inserted through opening 42 of cord locking mechanism 40. An example of such a cord locking mechanism is a well known cord lock used in sports and recreational outer wear and include a spring clamp against the cords. The button 44 is pushed down to allow the cords to be pulled through to a desired location. Release of the button 44 causes the spring clamp to lock the cord lock at that location. Other types of cord locking mechanisms are contemplated within the present invention as well.

The ends of the cords are then inserted through hole 52 of the ball 50. The ends of the cords are then knotted to prevent the cords from being pulled back through the ball. The knot is then pulled into recess 54 in the ball to be securely contained. The ball 50 is used not only to knot the ends of the cord together but as a handle as discussed in greater detail below.

Figure 2:
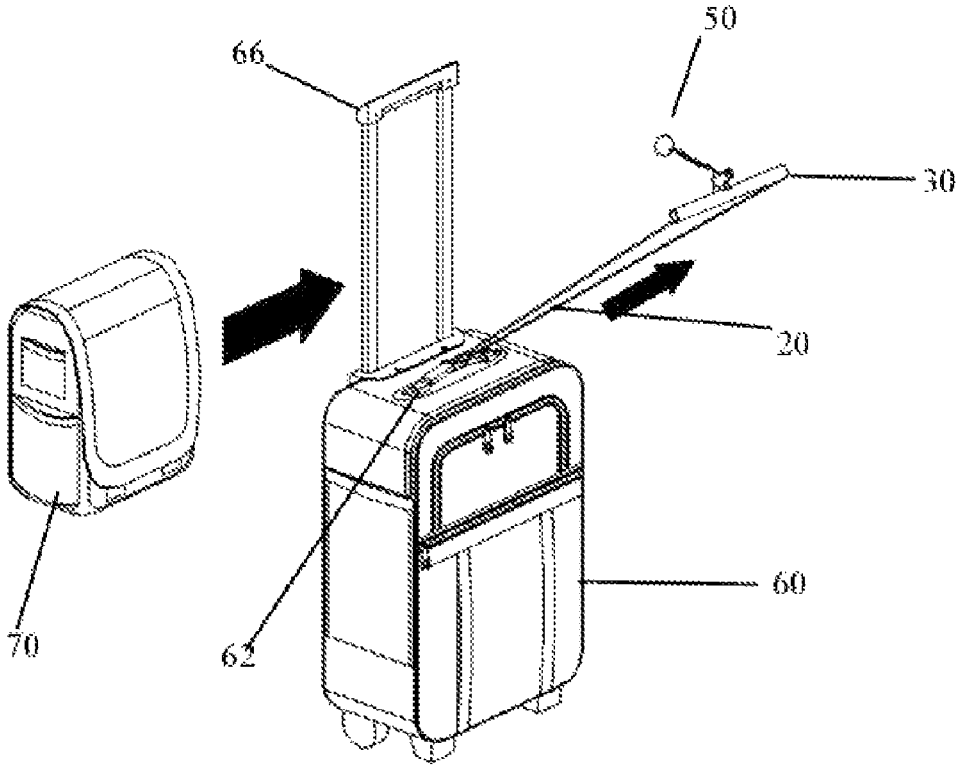
FIG. 2 is a perspective view of the system of FIG. 1 in initial use with an article of luggage.
Figure 3:
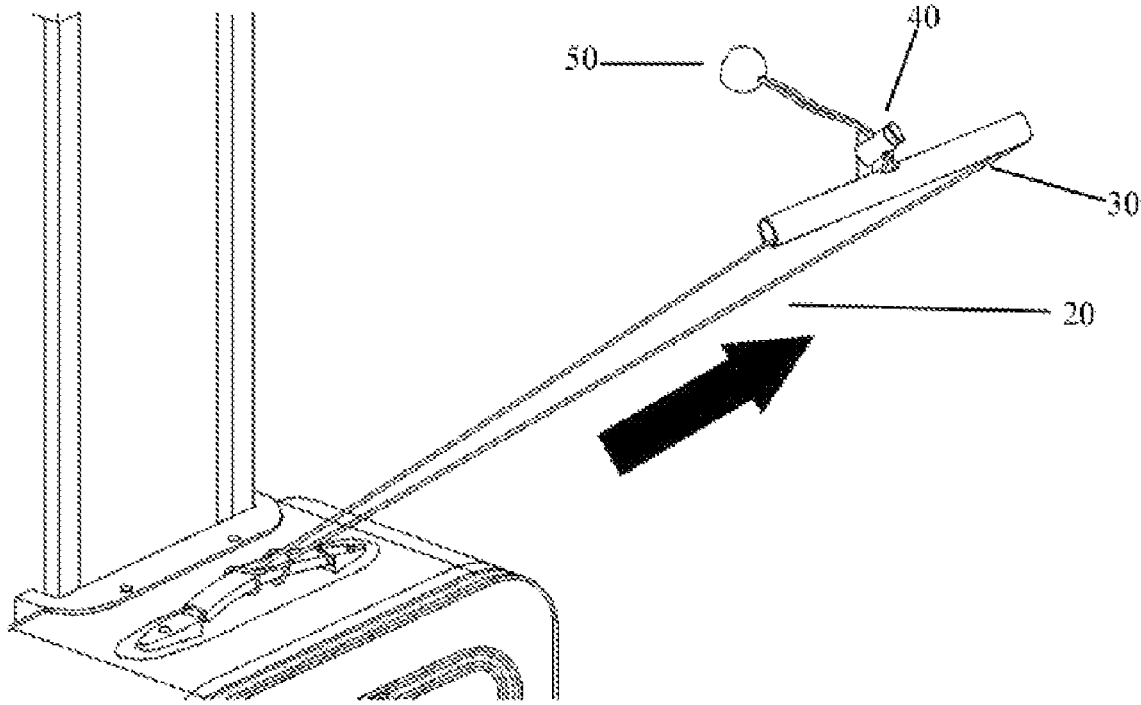
FIG. 3 is a close up view of the embodiment of FIG. 2.
Figure 4:
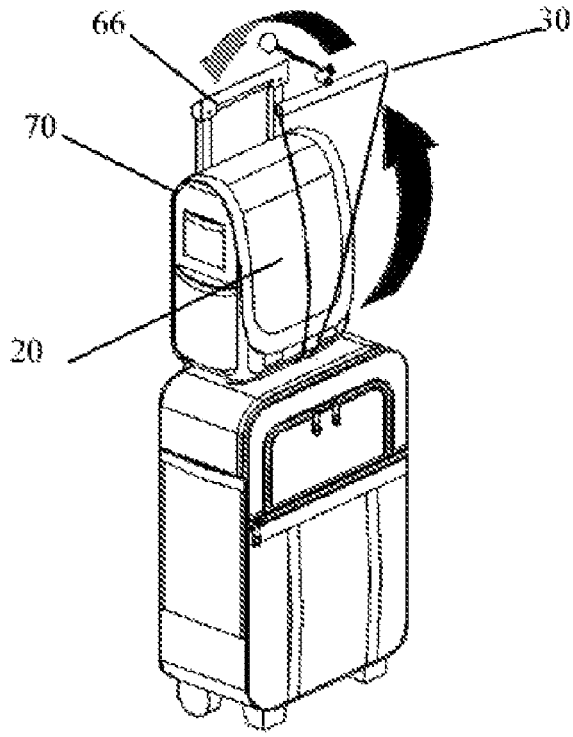
FIG. 4 is a perspective view of an intermediate view of installing the system of FIG. 1.

In use with a wheeled article of luggage, such as the luggage 60 shown in FIG. 2, the end of the cord 20 away from the handle 30 is inserted through the luggage handle 62. It is to be expressly understood that the cord could also engage any attachment point on the article of luggage. The handle 30 is then inserted through the loop of the cord and pulled taut away from the luggage handle 62 as shown in FIGS. 2 and 3. The second article of luggage, such as case 70 is then placed on the first article of luggage 60 between the extendible handle 66 and the cord 20 as shown in FIGS. 3 and 4. While a second article of luggage is discussed in this example, it is expressly acknowledged that personal items, packages or any other item may be secured as well.

Figure 5:
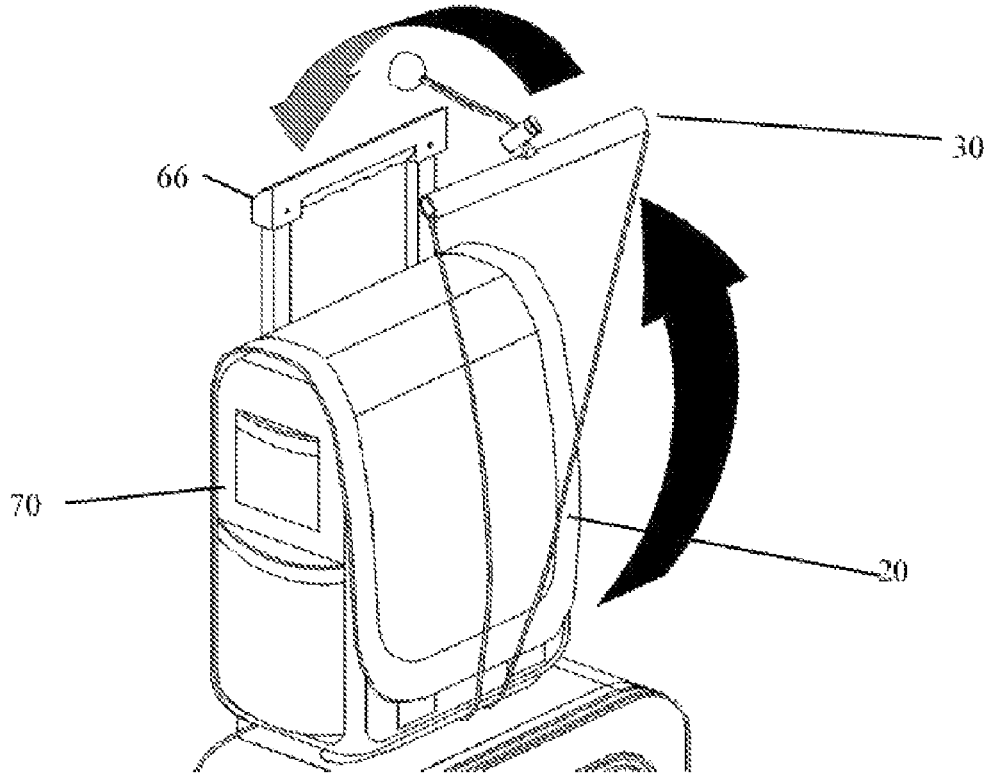
FIG. 5 is a close up view of the embodiment of FIG. 4.
Figure 6:
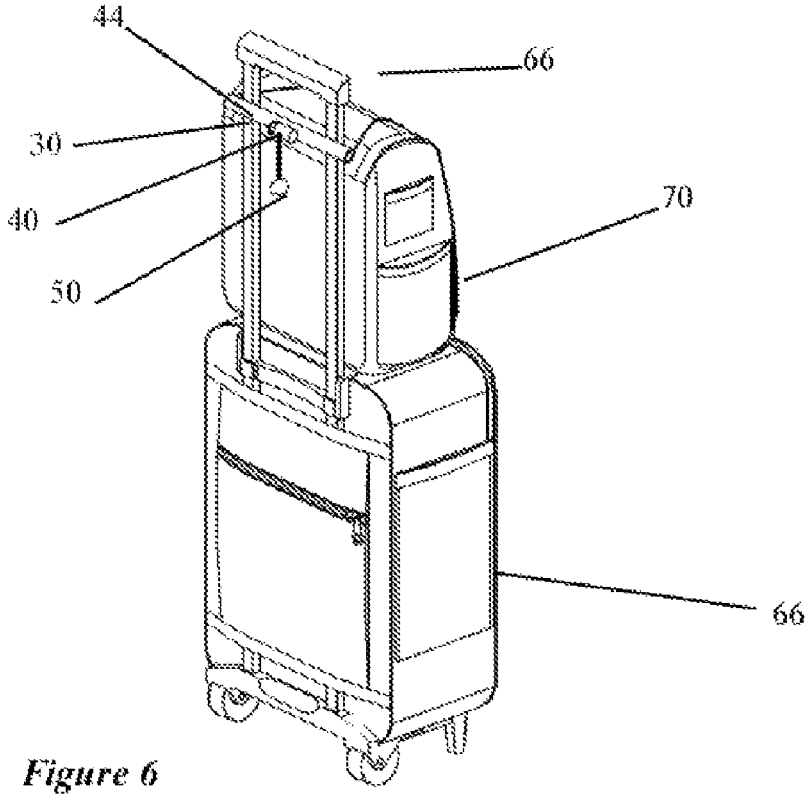
FIG. 6 is a rear perspective view of the system of FIG. 1 fully installed.
Figure 7:
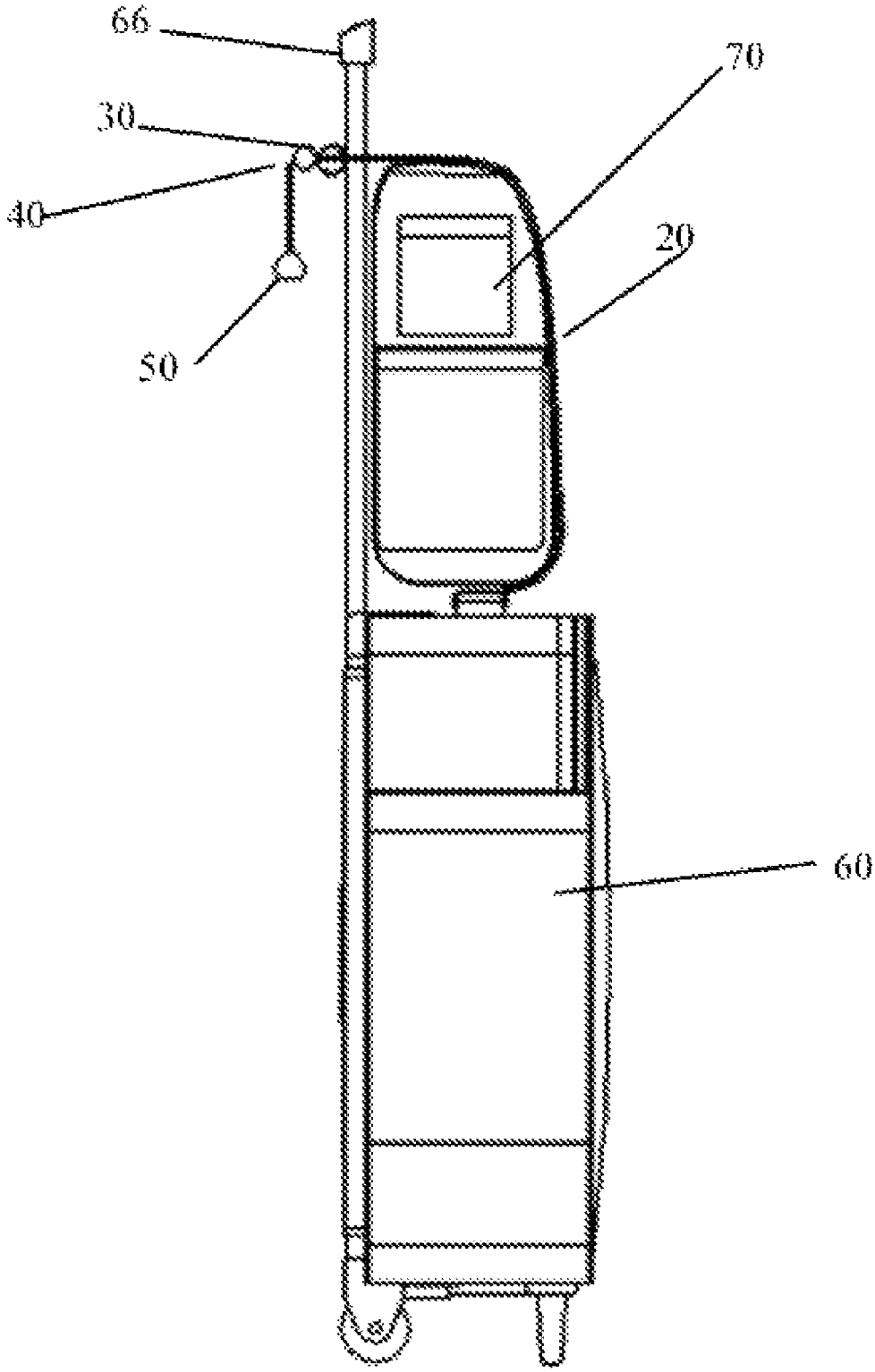
FIG. 7 is a side view of the embodiment of FIG. 6.

The handle 30 is then pulled upward and over the second article of luggage 70 as shown in FIGS. 4 and 5. The handle 30 is then pulled over the extendible handle 66 of the luggage or dolly so that the cord 20 is placed around the handle 66. The handle 30 is pulled downward over the extendible handle 66 so that the cord 20 securely engages the second article of luggage 70.

The cord 20 is then pulled tight by grasping the ball 50 with one hand and the button on the cord lock 40 with the other hand. With the button 44 on the cord lock 40 pressed down, the cord lock is pressed against the handle 30. This allows the ball 50 to be pulled away from the handle 30 and cord lock 40. Once the tension in the cord is sufficient, the button 44 is released to lock the cord lock against the handle 40 to maintain the tension on the cord against the second article of luggage.

Both articles of luggage are securely attached so that they can be safely and securely transported. It is also easy to gain access to either article of luggage as well. The adjustability of the securing system 10 of this preferred embodiment enables it to be used to secure more than one article of luggage to another as well as to allow any size of luggage to be secured to on another.

Once the securing system of this preferred embodiment has been secured, it can simply be kept engaged. The cord lock can be kept in place and the handle disengaged by pulling it up and over the extended handle. The cord lock normally does not need to be released if an elastic cord is used.

The system of this preferred embodiment can be easily adjusted if necessary such as if the item being secured to the first article differs significantly in size. The button 44 on the cord lock 40 is pushed down to allow the cord 20 to pull through the cord lock to release the tension on the cord. The second article of luggage may then be slipped out from under the cord, or the handle 30 and cord 20 can be lifted over the extendible handle 66 and removed from the handle 62 of the first article of luggage 60. The securing system 10 can be easily stored when not in use and can be adjusted to work with most types of luggage.

While the above embodiment was discussed for use with a wheeled article of luggage having a handle and extendible handle, it is to be expressly understood that system may also be used with other types of luggage including but not limited to non-wheeled luggage that are transported on a cart or dolly, or with stacked boxes, or any other type of luggage or case. The system may also be usable on any articles that are secured to another article, cargo bed, or any other item. The system of the present invention does not need to engage only through and over handles but may also engage with other attachment devices or attachment points such as hooks, rings, edges or any other suitable attachment point.

Also, the article securing system 10 can be used with non-luggage as well. This securing system 10 of this preferred embodiment can be used to secure any article since it is easily adjustable and can attach to many different attachment points including but not limited to hooks, rings, edges, loops, corners, etc. One end of the cord is engaged with one attachment point, then pulled over the article where the handle 30 is pulled over another attachment point, such as a hook. Then the cord is pulled taut by the ball and cord lock and secured. This allows it to be used with any type of article and in almost any situation.

In another preferred embodiment of the present invention, the cord lock 40 is incorporated integrally in the handle 30. This allows the user to grasp the ball 50 with one hand and the handle 30 with the other to pull the ball away from the handle to adjust the tension on the cord 20.

The present invention is not intended to be limited by the above descriptive embodiments that are being provided for explanatory purposes only. Other embodiments are considered to be within the scope of the claimed invention.

What is being claimed is:

1. A luggage securement system for attaching additional articles to an article of wheeled luggage, said securement system comprising:

an article of wheeled luggage;

an extendable handle on said wheeled luggage;

a luggage handle on said wheeled luggage;

an elongated handle;

a passageway through said elongated handle;

a first opening on said passageway;

a second opening on said passageway;

an aperture extending into said passageway;

a cord;

a first end on said cord extending into said first opening into said passageway and through said aperture;

a second end on said cord extending into said second opening into said passageway and through said aperture so said cord forms a single loop that engages over at least one additional article;

an engagement mechanism on the end of said single loop away from said elongated handle for engaging said luggage handle; and a surface on said elongated handle for engaging said extendable handle assembly on said article of wheeled luggage to secure at least one additional article to said article of wheeled luggage.

2. The luggage securement system of claim 1 wherein said system further includes:

a mechanism for adjusting the tension of said cord.

3. The luggage securement system of claim 2 wherein said system further includes:

a second handle mounted on said cord so that said mechanism for adjusting the tension of said cord is between said second handle and said handle.

4. A luggage securement system for attaching additional articles to an article of wheeled luggage, said securement system comprising:

an article of wheeled luggage;

an extendable handle on said wheeled luggage;

a luggage handle on said wheeled luggage;

an elongated handle;

a passageway through said elongated handle;

a first opening on said passageway;

a second opening on said passageway;

an aperture extending into said passageway;

a cord extending through said passageway and through said aperture so said cord forms a single loop that engages over at least one additional article;

an engagement mechanism on the end of said single loop away from said elongated handle for engaging said luggage handle; and a surface on said elongated handle for engaging said extendable handle assembly on said article of wheeled luggage to secure at least one additional article to said article of wheeled luggage.

5. The luggage securement system of claim 4 wherein said system further includes:

a mechanism for adjusting the tension of said cord.

6. The luggage securement system of claim 5 wherein said system further includes:

a second handle mounted on said cord so that said mechanism for adjusting the tension of said cord is between said second handle and said handle.

* * * * *